US007185885B2

(12) United States Patent
Chelvayohan

(10) Patent No.: US 7,185,885 B2
(45) Date of Patent: Mar. 6, 2007

(54) PRINT MEDIA DEPLETION DETECTION IN AN IMAGING APPARATUS

(75) Inventor: Mahesan Chelvayohan, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 240 days.

(21) Appl. No.: 10/726,429

(22) Filed: Dec. 3, 2003

(65) Prior Publication Data

US 2005/0122359 A1 Jun. 9, 2005

(51) Int. Cl.
*B65H 7/08* (2006.01)

(52) U.S. Cl. ..... 271/110; 271/38; 347/104

(58) Field of Classification Search ..... 271/38, 271/110, 265.01, 25, 31, 130; 347/104, 37, 347/16

See application file for complete search history.

(56) References Cited

U.S. PATENT DOCUMENTS 4,888,617 A 12/1989 Okuzawa
5,016,864 A 5/1991 Nonami
5,897,112 A 4/1999 Kwag
5,915,690 A 6/1999 Surya
6,206,594 B1 * 3/2001 Elgee et al. ..... 400/703
6,292,636 B1 9/2001 Kwon
6,390,703 B1 * 5/2002 Kinas et al. ..... 400/708
2004/0061283 A1 * 4/2004 Hyun ..... 271/265.01
2004/0135106 A1 * 7/2004 Bolash et al. ..... 250/559.4

FOREIGN PATENT DOCUMENTS

JP 5-186093 7/1993

* cited by examiner

*Primary Examiner*—Patrick Mackey
*Assistant Examiner*—Thomas Morrison
(74) *Attorney, Agent, or Firm*—Taylor & Aust

(57) ABSTRACT

An imaging apparatus includes a sensor, and a carrier system configured to transport the sensor along a scanning path. A mid-frame is provided having a slot formed along the scanning path. A print media support is provided for holding a supply of print media. A print media detection device is positioned below the mid-frame. The print media detection device includes a first end and a second end. The first end has a sense surface, wherein the sensor senses one of a presence and an absence of the sense surface in the slot of the mid-frame as a determination of the depletion of the supply of print media at the print media support.

15 Claims, 2 Drawing Sheets

PRINT MEDIA DEPLETION DETECTION IN AN IMAGING APPARATUS

BACKGROUND OF THE INVENTION

1. Field of the Invention

The present invention relates to an imaging apparatus, and, more particularly, to print media depletion detection in an imaging apparatus.

2. Description of the Related Art

An imaging apparatus, such as an ink jet printer, having a back loading print media tray, typically detects the presence or absence of print media in the print media tray by a media sensor positioned adjacent the stack of print media.

In another imaging apparatus, such as an ink jet printer, having a front loading paper tray, the depletion of the print media in the print media tray may be determined by trying to pick a sheet of print media, and if the sheet does not load within a predetermined amount of time, then it is determined that the print media tray is empty. Such a method adds time to the completion of a print job, and adds wear and stress to the sheet picking mechanism.

What is needed in the art is a print media depletion detection unit suitable for use in an imaging apparatus having a front-loading print media tray, which may utilize an existing sensor, such as a printhead alignment sensor, present in the imaging device for detection of the depletion of the print media in the print media tray without having to try to pick a sheet of print media to make such a determination.

SUMMARY OF THE INVENTION

The present invention provides a print media depletion detection unit suitable for use in an imaging apparatus having a front-loading print media tray, which may utilize an existing sensor, such as a printhead alignment sensor, present in the imaging device for detection of the depletion of the print media in the print media tray without having to try to pick a sheet of print media to make such a determination.

The present invention, in one form thereof, relates to an imaging apparatus. The imaging apparatus includes a sensor, and a carrier system configured to transport the sensor along a scanning path. A mid-frame is provided having a slot formed along the scanning path. A print media support is provided for holding a supply of print media. A print media detection device is positioned below the mid-frame. The print media detection device includes a first end and a second end. The first end has a sense surface, wherein the sensor senses one of a presence and an absence of the sense surface in the slot of the mid-frame as a determination of the depletion of the supply of print media at the print media support.

In another form thereof, the present invention relates to a method for performing print media depletion detection in an imaging apparatus, including the steps of providing a mid-frame having a slot; providing a sensor locatable over the slot; providing a print media support for holding a supply of print media; providing a print media detection device having a sense surface; and detecting with the sensor one of a presence and an absence of the sense surface in the slot of the mid-frame as a determination of the depletion of the supply of print media at the print media support.

An advantage of the present invention is that print media depletion detection may be realized in an imaging apparatus having a front-loading print media tray by using an existing sensor, such as a printhead alignment sensor.

Another advantage of the present invention is that detection of the depletion of the print media in the print media tray can be realized without having to try to pick a sheet of print media to make such a determination.

BRIEF DESCRIPTION OF THE DRAWINGS

The above-mentioned and other features and advantages of this invention, and the manner of attaining them, will become more apparent and the invention will be better understood by reference to the following description of an exemplary embodiment of the invention taken in conjunction with the accompanying drawings, wherein.

Corresponding reference characters indicate corresponding parts throughout the several views. The exemplifications set out herein illustrate an embodiment of the invention, in one form, and such exemplifications are not to be construed as limiting the scope of the invention in any manner.

DETAILED DESCRIPTION OF THE INVENTION

Figure 1:
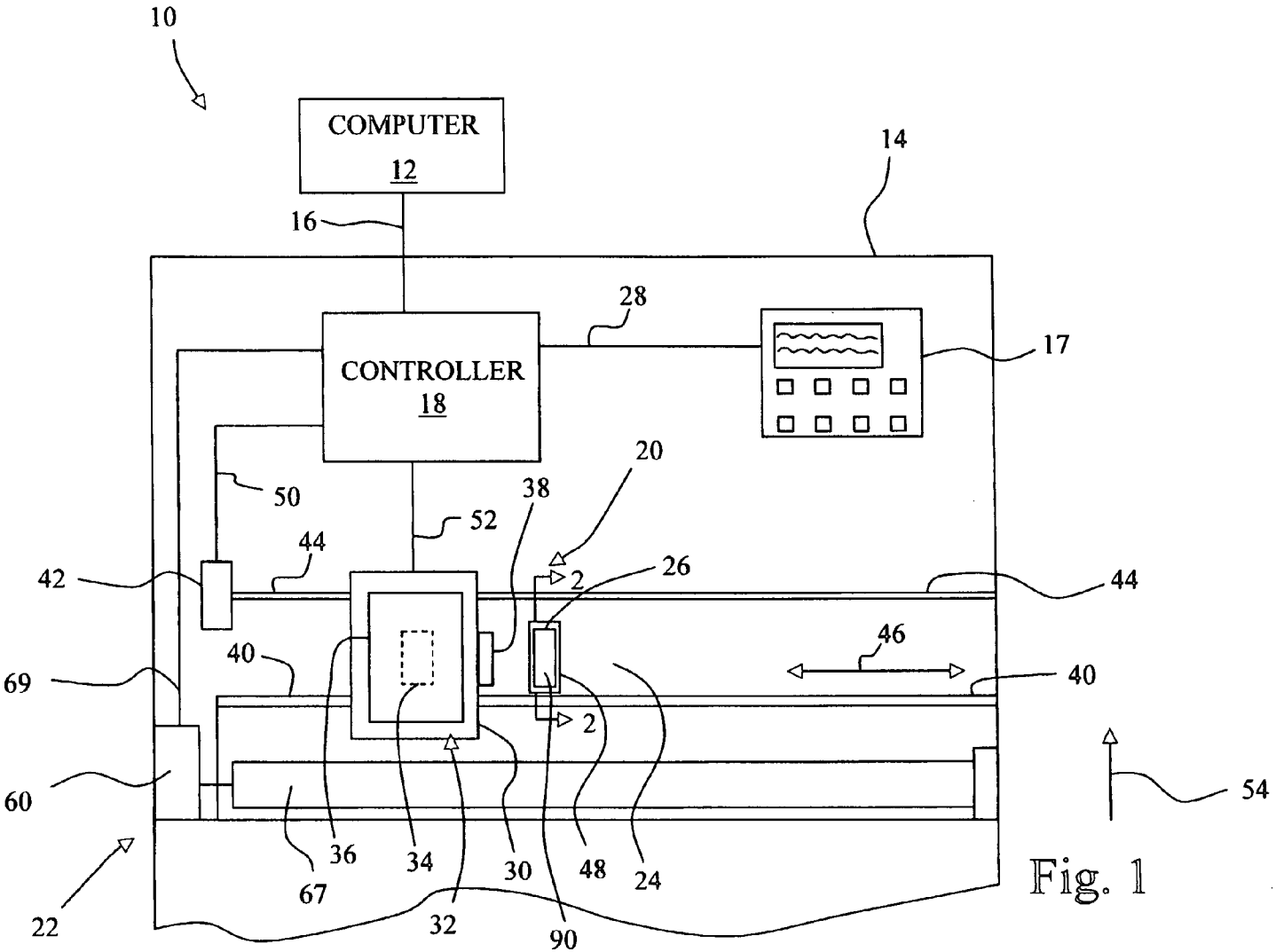
FIG. 1 is a diagrammatic representation of an imaging system employing an embodiment of the present invention, including a diagrammatic top view of an imaging apparatus.

Referring now to the drawings and particularly to FIG. 1, there is shown an imaging system 10 embodying of the present invention. Imaging system 10 includes a computer 12 and an imaging apparatus in the form of an ink jet printer 14. Ink jet printer 14 may, for example, be used as the print engine in a multifunction device, such as a device that also includes faxing and copying capabilities. Computer 12 is communicatively coupled to ink jet printer 14 by way of communications link 16. Communications link 16 may be, for example, a wired connection, such as a USB connection, a wireless connection, such as an optical connection, e.g., an infrared connection, an r.f. connection, or a standard wireless protocol, e.g., Bluetooth; or a network connection, such as an Ethernet Local Area Network.

Computer 12 is typical of that known in the art, and may include a monitor to display graphics or text, an input device such as a keyboard and/or mouse, a microprocessor, and associated memory, such as random access memory (RAM), read only memory (ROM) and a mass storage device, such as CD-ROM or DVD hardware. Ink jet printer 14 includes a user interface 17, a controller 18, a printhead carrier system 20, a media feed unit 22, a mid-frame 24, and a print media depletion detection device 26.

Controller 18 may include, for example, a microprocessor having an associated random access memory (RAM) and read only memory (ROM). Controller 18 may be in the form of an application specific integrated circuit (ASIC). Controller 18 may be communicatively coupled to user interface 17 of ink jet printer 14 via a communications link 28, such as a multi-conductor cable.

Printhead carrier system 20 includes, for example, a printhead carrier 30 for carrying one or more printhead cartridges, such as a color printhead cartridge and/or monochrome printhead cartridge, which is mounted thereto. For convenience, a single printhead cartridge 32 is shown. Printhead cartridge 32 includes an ink jet printhead 34 provided in fluid communication with an ink reservoir 36.

Also mounted to printhead carrier 30 is a sensor 38, such as for example, a printhead alignment sensor.

Sensor 38 includes electrical sensory components. For example, where sensor 38 is an optical sensor, such electrical sensory components may include a light source, and a specular detector and/or a diffuse detector, the configuration and operation of which is known in the art. In its simplest form, the light source may include, for example, a light emitting diode (LED). In a more complex form, the light source may further include additional optical components for generating a collimated light beam. Each of the specular detector and/or the diffuse detector can be, for example, a phototransistor. The phototransistor provides an analog signal output whose voltage, or current, output varies as a function of the intensity of the reflected light that it receives from a reflective surface. Sensor 38 may further include analog-to-digital conversion circuitry for converting the analog signal into a digital signal that can be read directly by controller 18.

Printhead carrier system 20 further includes a guide member 40, a carrier drive unit 42 and a carrier drive belt 44. A guide member 40 guides printhead carrier 30 and facilitates bi-directional reciprocating movement of printhead carrier 30. Guide member 40 may include one or more guide rods and/or a guide tab formed integral with the frame of ink jet printer 14. Guide member 40 defines a bi-directional scanning path 46 of printhead carrier 30 over mid-frame 24.

Mid-frame 24 includes a slot 48 positioned along bi-directional scan path 46, and more particularly, slot 48 is positioned such that sensor 38 will pass over slot 48 when printhead carrier 30 is scanned along bi-directional scan path 46.

Carrier drive unit 42 is electrically connected to controller 18 via a communications link 50, which may be in the form of a multi-conductor cable. Carrier drive unit 42 may include, for example, a transmission device, such as a carrier pulley, attached to the shaft of a carrier motor, such as a direct current motor or a stepper motor. Printhead carrier 30 is connected to carrier drive belt 44, which in turn is coupled in driving engagement with carrier drive unit 42. At a directive of controller 18, printhead carrier 30 is transported via carrier drive unit 42 and carrier drive belt 44 in a reciprocating manner along bi-directional scanning path 46, back and forth along guide member 40.

Ink jet printhead 34 and sensor 38 are electrically connected to controller 18 via a communications link 52, which may be in the form of one or more multi-conductor cables. Controller 18 supplies electrical address and control signals to ink jet printer 14, and in particular, to the ink jetting actuators of ink jet printhead 34, to effect the selective ejection of ink from ink jet printhead 34. In addition, communications link 52 receives sensor signals supplied by sensor 38, which in turn are supplied to controller 18.

Figure 2:
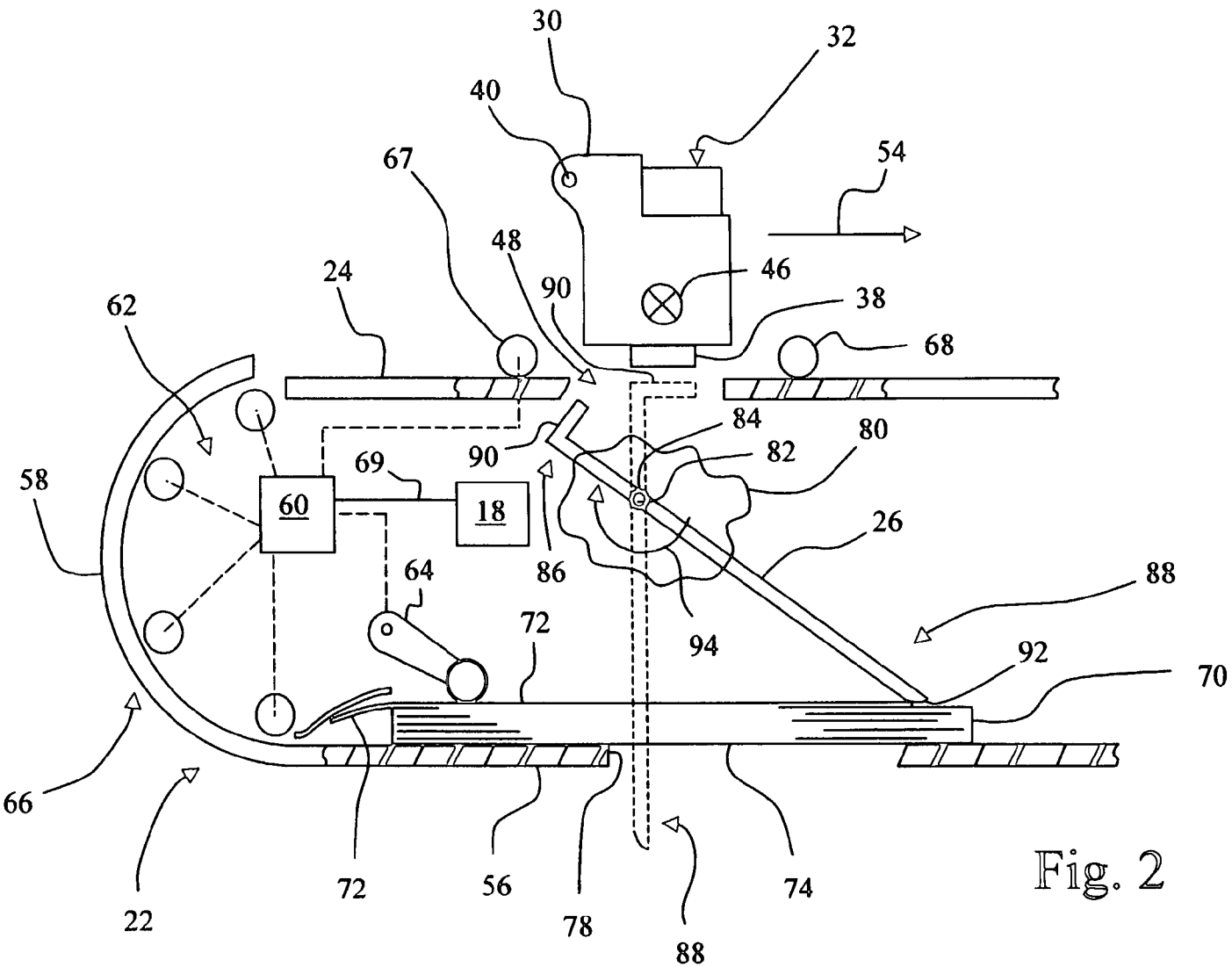
FIG. 2 is a diagrammatic side view, in partial section, of the imaging apparatus of the imaging system of FIG. 1.

Referring now also to FIG. 2, media feed unit 22 conveys a sheet of print media, such as top sheet 72, under printhead 34 during a printing operation in sheet feed direction 54. Media feed unit 22 includes a print media support 56, a C-shaped media path 58, a print media feed drive 60, a drive train 62, a sheet picking mechanism 64, a plurality of conveyance rollers 66, a feed roller 67, and an exit roller 68. Print media feed drive 60 may include, for example, a motor, such as a D.C. motor or a stepper motor. Drive train 62 is depicted by dashed lines, and includes a power transmission device, such as a gear train or belt/pulley arrangement.

Drive train 62 is connected to print media feed drive 60, and is also connected to sheet picking mechanism 64, conveyance rollers 66, feed roller 67 and exit roller 68. Conveyance rollers 66, as shown, include four rollers positioned along C-shaped paper path 58. Feed roller 67 is positioned upstream of ink jet printhead 34, and exit roller 68 is positioned downstream of ink jet printhead 34, with respect to sheet feed direction 54. Print media feed drive 60 is electrically connected to controller 18 via a communications link 69, such as for example, a multi-conductor cable.

As shown in FIG. 2, ink jet printer 14 contains at print media support 56 a stack of print media 70, including a top sheet 72 and a bottom sheet 74. Print media 70 may be any suitable substrate for receiving printed indicia, such as for example, paper or transparencies.

Print media support 56 may be, for example, a front-loading media tray that is inserted into ink jet printer 14 in a direction substantially parallel and opposite to sheet feed direction 54, and holds a stack of print media 70. Print media support 56 includes a slot 78, which may be similar in appearance to slot 48 of mid-frame 24.

Print media detection device 26 may, for example, be in the form of a rotatable flag pivotably mounted to a frame portion 80 of ink jet printer 14 via a pivot pin 82 and hole 84. Pivot pin 82 defines a pivot axis for print media detection device 26. For convenience, the pivot axis defined by pivot pin 82 may be referred to using the same element number, i.e., as pivot axis 82. Pivot pin 82 may be attached to frame portion 80 and hole 84 may be formed in print media detection device 26 for receiving pivot pin 82, such that print media detection device 26 pivots about pivot pin 82. Alternatively, pivot pin 82 may be attached to print media detection device 26, and hole 84 may be formed in frame portion 80 for receiving pivot pin 82, such that print media detection device 26 pivots as pin 82 pivots in hole 84.

In the embodiment shown, print media detection device 26 is formed as an L-shaped member. Print media detection device 26 includes a first end 86 and a second end 88, with pivot axis 82 positioned between first end 86 and second end 88. The location of pivot axis 82 may be selected such that second end 88 of print media detection device 26 operates as a pendulum, thereby seeking a rest position based on the forces of gravity. First end 86 includes a sense surface 90, which is made of a material to contrast with the void of slot 48. Second end 88 of print media detection device 26 includes a print media engaging portion 92.

Print media detection device 26 is shown having two positions: a print media present position (shown in FIG. 2 using solid lines) when sense surface 90 is not present in slot 48 along scanning path 46, and a print media depleted, i.e., not present, position (shown in FIG. 2 using dashed lines) when sense surface 90 is present in slot 48 along scanning path 46.

If, in the absence of sense surface 90 in slot 48, the void of slot 48 is dark, then sense surface 90 of print media detection device 26 will be made of a light reflecting material to contrast with the darkness of slot 48. Thus, sense surface 90 may be formed, for example, by coating first end 86 of print media detection device 26 with a light reflective coating, or by attaching a reflective material to first end 86 of print media detection device 26.

If, however, in the absence of sense surface 90 in slot 48, the void of slot 48 is lighted (as in the case where backlighting is present), then sense surface 90 of print media detection device 26 may be made of a light absorbing material to contrast with the light of slot 48. Thus, sense surface 90 may be formed, for example, by coating first end 86 of print media detection device 26 with a light absorbing coating.

During operation, print media engaging portion 92 of print media detection device 26 contacts the topmost sheet of print media, such as top sheet 72, when print media 70 is present at print media support 56. Print media support 56 may, for example, be a paper tray holding a supply of print media 70. Print media engaging portion 92 of print media detection device 26 may be maintained in contact with print media 70 by gravity, or alternatively, may include a torsion assist provided by a spring (not shown). As each sheet is removed from the stack of print media 70, print media detection device 26 will pivot slightly about pivot axis 82 in pivot direction 94. However, upon removal of bottom sheet 74 from print media support 56, print media detection device 26 undergoes significant pivoting as second end 88 of print media detection device 26, including print media engaging portion 92, drops into slot 78 of print media support 56, and simultaneously, first end 86 of print media detection device 26, including sense surface 90, is positioned in slot 48 of mid-frame 24.

During print media depletion detection, with no print media sheet present over slot 48 of mid-frame 24, controller 18 directs printhead carrier 30 to scan or position sensor 38 along bi-directional scanning path 46 over slot 48. If sense surface 90 of print media detection device 26 is present in slot 48, then sensor 38 provides a signal to controller 18 indicating the depletion of print media 70 at print media support 56. Controller 18 may then respond by generating a message at computer 12 indicating the depletion of the supply of print media in ink jet printer 14. Alternatively, such an indication of the depletion of the supply of print media in ink jet printer 14 may be made at ink jet printer 14, such as by generating a display at a user interface 17 of ink jet printer 14. At this time, controller 18 does not permit printing with ink jet printer 14 until the supply of print media 70 at print media support 56 is replenished.

If, however, the presence of sense surface 90 of print media detection device 26 is not detected in slot 48 of mid-frame 24, controller 18 will permit printing to proceed, as follows. At a directive of controller 18, print media feed drive 60 causes a sheet of print media, such as top sheet 72, to be picked from the stack of print media 70 by sheet picking mechanism 64. Sheet 72 is then transported by conveyance rollers 66 around C-shaped media path 58 to feed roller 67. Feed roller 67 then transports sheet 72 over mid-frame 24 and under ink jet printhead 34 in an indexed manner. During printing, controller 18 controls the movement of printhead carrier 30 so as to cause printhead carrier 30 to move in a controlled reciprocating manner, back and forth along guide member 40, along bi-directional scanning path 46. Controller 18 supplies electrical address and control signals to the ink jetting actuators of printhead 34 to effect the selective ejection of ink from printhead 34.

Following the printing of each sheet of print media, the print media depletion detection process, as outlined above, may be repeated.

While the embodiment shown in FIGS. 1 and 2, and described above, determines the depletion of print media 70 at print media support 56 by detecting the presence of sensor surface 90 at slot 48 of mid-frame 24 by sensor 38, those skilled in the art will recognize that the embodiment may be modified such that the presence of sensor surface 90 may be indicative of the presence of print media 70 at print media support surface 56 by simply changing the shape of print media detection device 26.

While this invention has been described with respect to an embodiment of the invention, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus, comprising:

a sensor;

a carrier system configured to transport said sensor along a scanning path;

a mid-frame having a slot formed along said scanning path;

a print media support for holding a supply of print media; and a print media detection device positioned below said mid-frame, said print media detection device including a first end and a second end, said first end having a sense surface, wherein said sensor senses one of a presence and an absence of said sense surface in said slot of said mid-frame as a determination of the depletion of said supply of print media at said print media support.

2. The imaging apparatus of claim 1, wherein said print media detection device is configured such that when said print media is present at said print media support, said sense surface is not positioned in said slot of said mid-frame for detection by said sensor, and wherein if said print media is not present at said print media support, said sense surface is positioned in said slot of said mid-frame for detection by said sensor.

3. The imaging apparatus of claim 1, wherein said print media detection device includes a pivot axis disposed between said first end of said print media detection device and said second end of said print media detection device, said second end engaging a topmost sheet of said print media when said print media is present at said print media support.

4. The imaging apparatus of claim 3, wherein said print media detection device pivots about said pivot axis until said sense surface of said print media detection device is positioned in said slot of said mid-frame, in the absence of said print media at said print media support.

5. The imaging apparatus of claim 1, said print media detection device being positioned between said mid-frame and said print media support, said second end engaging a topmost sheet of said print media when said print media is present at said print media support.

6. The imaging apparatus of claim 1, further comprising:

a display device; and a controller coupled to said display device and coupled to said sensor, said sensor sending a signal to said controller indicating an absence of said print media at said print media support when said sensor senses the presence of said sense surface of said print media detection device in said slot of said mid-frame, said controller causing an indication to be generated at said display device to indicate said absence of said print media at said print media support.

7. The imaging apparatus of claim 1, wherein said print media support is a front-loading print media tray.

8. The imaging apparatus of claim 1, wherein said sensor is an optical sensor.

9. The imaging apparatus of claim 1, said carrier system including a printhead carrier configured to carry at least one ink jet printhead, said sensor being mounted to said printhead canier.

10. The imaging apparatus of claim 1, further comprising a C-shaped print media path coupled between said print media support and said mid-frame to facilitate delivery of a print media sheet from said supply of print media at said print media support to said mid-frame.

11. A method for performing print media depletion detection in an imaging apparatus, comprising the steps of:

providing a printhead canier configured to carry at least one ink jet printhead:

providing a mid-frame having a slot;

providing a sensor mounted on said printhead carrier and locatable over said slot;

providing a print media support for holding a supply of print media;

providing a print media detection device having a sense surface; and detecting with said sensor one of a presence and an absence of said sense surface in said slot of said mid-frame as a determination of the depletion of said supply of print media at said print media support, wherein said sense surface is formed at a first end of said print media detection device and a second end of said print media detection device engages a topmost sheet of said print media when said print media is present at said print media support.

12. The method of claim 11, further comprising the step defining a pivot axis for said print media detection device disposed between said first end of said print media detection device and said second end of said print media detection device.

13. The method of claim 12, wherein said print media detection device pivots about said pivot axis until said sense surface of said print media detection device is positioned in said slot of said mid-frame in the absence of said print media at said print media support.

14. The method of claim 11, wherein said sensor is a printhead alignment sensor.

15. The method of claim 11, wherein said detecting with said sensor includes directing said printhead carrier to position said sensor over said slot.

* * * * *